US010179358B2

(12) United States Patent
Huang

(10) Patent No.: US 10,179,358 B2
(45) Date of Patent: Jan. 15, 2019

(54) ROTARY PIPE SIZING TOOL

(71) Applicant: YUNG CHI INDUSTRY CO., LTD., Taichung (TW)

(72) Inventor: Wu-Sheng Huang, Taichung (TW)

(73) Assignee: Yung Chi Industry Co., Ltd., Taichung (TW)

( * ) Notice: Subject to any disclaimer, the term of this patent is extended or adjusted under 35 U.S.C. 154(b) by 69 days.

(21) Appl. No.: 15/399,849

(22) Filed: Jan. 6, 2017

(65) Prior Publication Data

US 2018/0193898 A1 Jul. 12, 2018

(51) Int. Cl.

| | |
|---|---|
| ***B21D 39/20*** | (2006.01) |
| ***B21D 41/02*** | (2006.01) |
| ***B21D 41/04*** | (2006.01) |
| *B21D 19/08* | (2006.01) |

(52) U.S. Cl.
CPC ..... *B21D 41/021* (2013.01); *B21D 41/04* (2013.01); *B21D 19/08* (2013.01)

(58) Field of Classification Search
CPC ..... B21D 41/021; B21D 41/04; B21D 19/08
USPC ..... 72/462
See application file for complete search history.

(56) References Cited

U.S. PATENT DOCUMENTS

| | | | | |
|---|---|---|---|---|
| 3,040,800 | A * | 6/1962 | Hartley | B21D 41/023 72/119 |
| 3,109,479 | A * | 11/1963 | Wolcott | B21D 41/021 72/317 |
| 3,748,886 | A * | 7/1973 | Wolcott | B21D 41/021 72/316 |
| 4,754,634 | A * | 7/1988 | Murata | B21D 17/025 72/317 |
| 6,619,099 | B2 | 9/2003 | Barjesteh | |
| 8,671,732 | B2 | 3/2014 | Chen | |
| 9,162,275 | B2 | 10/2015 | Cheng | |
| 2013/0133394 | A1* | 5/2013 | Hasenberg | B21D 41/021 72/312 |
| 2015/0114068 | A1* | 4/2015 | Hasenberg | B21D 41/021 72/312 |

* cited by examiner

*Primary Examiner* — David B Jones
(74) *Attorney, Agent, or Firm* — Wang Law Firm, Inc.

(57) ABSTRACT

A rotary pipe sizing tool for expanding or shrinking a pipe includes a main member having a driving portion, a clamping device provided at an end of the driving portion of the main member; and a rotating mechanism provided between the main member and the clamping device. The clamping device is free to rotate relative to the main member through the rotating mechanism to make the rotary pipe sizing tool operate in a narrow or a space that is hard to reach.

8 Claims, 7 Drawing Sheets

ROTARY PIPE SIZING TOOL

BACKGROUND OF THE INVENTION

1. Technical Field

The present invention relates to a hand tool, and more particularly to a rotary pipe sizing tool, which is driven by a power to expand and shrink an end of a pipe.

2. Description of Related Art

Typically, a conventional pipe sizing toll is applied to expand and shrink an end of a pipe, so that the expanded or shrunk pipe could be connected to the other pipe. Because the pipes usually are arranged at the corners of a room, the sizing process has to be performed at a narrow space or a space that is hard to reach.

U.S. Pat. No. 6,619,099 disclosed a hydraulically powered flaring hand tool, which has a hydraulic pump and a flaring piston arranged in a line. Therefore, the clamping device for holding the pipe is arranged in the same line. As a result, the flaring hand tool has a large length, which is hard to operate it in a narrow space. Besides, this patent did not disclose how the clamping device rotate relative to the hydraulically pump. In spite of that, this patent still has the drawback of large length.

U.S. Pat. No. 8,671,732 disclosed an oil-pressure swaging tool for rebuilding a connecting pipe, which has an oil-pressure device and an axial member for faring arranged in a line. This patent still has the drawback of large length, which is hard to operate in a narrow space or a space hard to reach.

U.S. Pat. No. 9,162,275 disclosed a flaring tool, which has a main member with a manual hydraulic pump and a tank for storing hydraulic liquid. The main member is fixed to the tank with an angle. The flaring tool further includes an expanding device arranged in the main member. Since there is a fixed angle between the main member and the tank, it is not helpful to operate the flaring tool in a narrow space or a space hard to reach.

BRIEF SUMMARY OF THE INVENTION

In view of the above, the primary objective of the present invention is to provide a rotary pipe sizing tool, which has a short length and is easy to be operated in a narrow space or a space hard to reach.

In order to achieve the objective of the present invention, a rotary pipe sizing tool for changing a diameter of a pipe includes a main member having a driving portion, a clamping device provided at an end of the driving portion of the main member; and a rotating mechanism provided between the main member and the clamping device. The clamping device is free to rotate relative to the main member through the rotating mechanism.

In an embodiment, the rotating mechanism has a neck portion and a slot; the neck portion is provided on the main member, and the slot is provided on the clamping device; the neck portion engages the slot to make the clamping device rotate freely relative to the main member.

In an embodiment, the rotating mechanism includes a recess on the clamping device and an engaging block on the main member to engage the recess.

In an embodiment, the clamping device is provided with a bore on a bottom of the recess, and the engaging block engages the recess with a portion passing through the bore to hold the clamping device on the main member.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
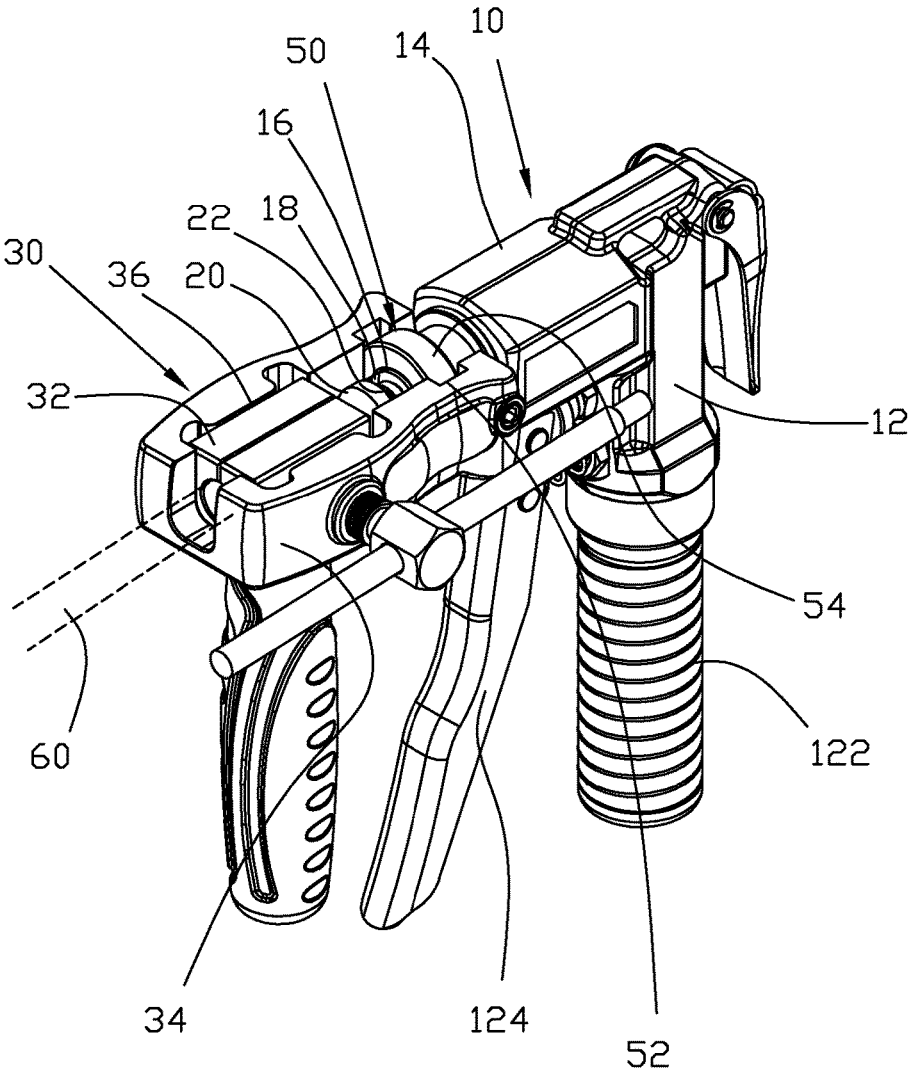
FIG. 1 is a perspective view of a preferred embodiment of the present invention.
Figure 2:
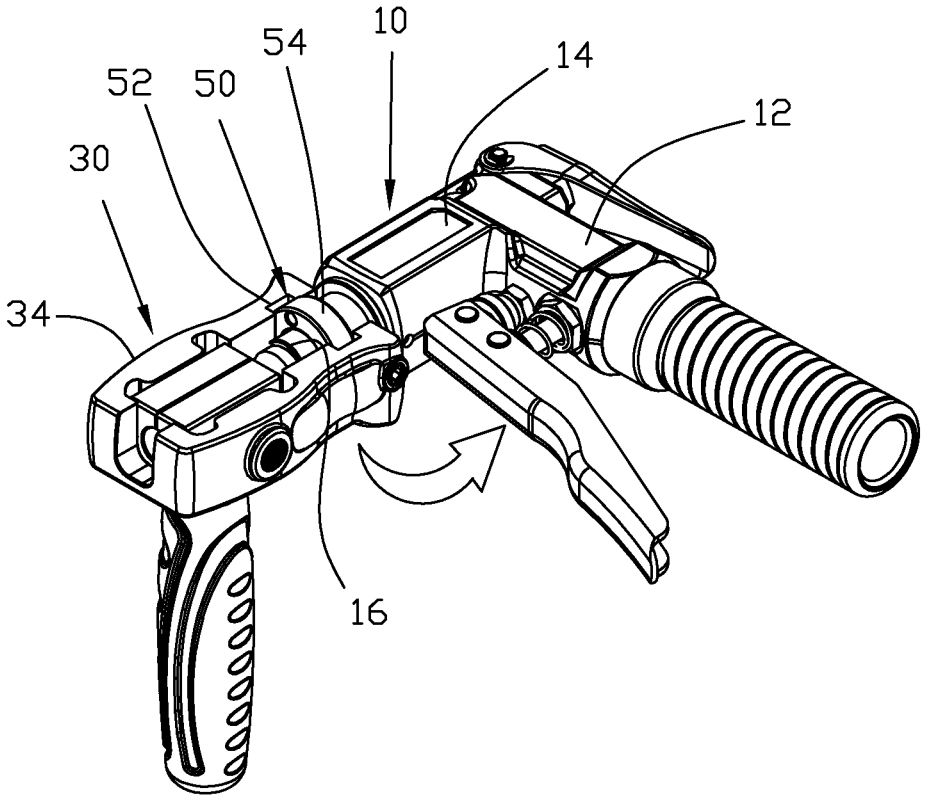
FIG. 2 is a perspective view of the preferred embodiment of the present invention, showing the clamping device being turned for an angle.

As shown in FIGS. 1 and 2, a rotary pipe sizing tool of the preferred embodiment of the present invention includes a main member 10, a clamping device 30, and a rotating mechanism 50. The rotating mechanism 50 is arranged between the main member 10 and the clamping device 30, and connected thereto, which allows the clamping device 30 to be rotated relative to the main member 10.

Figure 3:
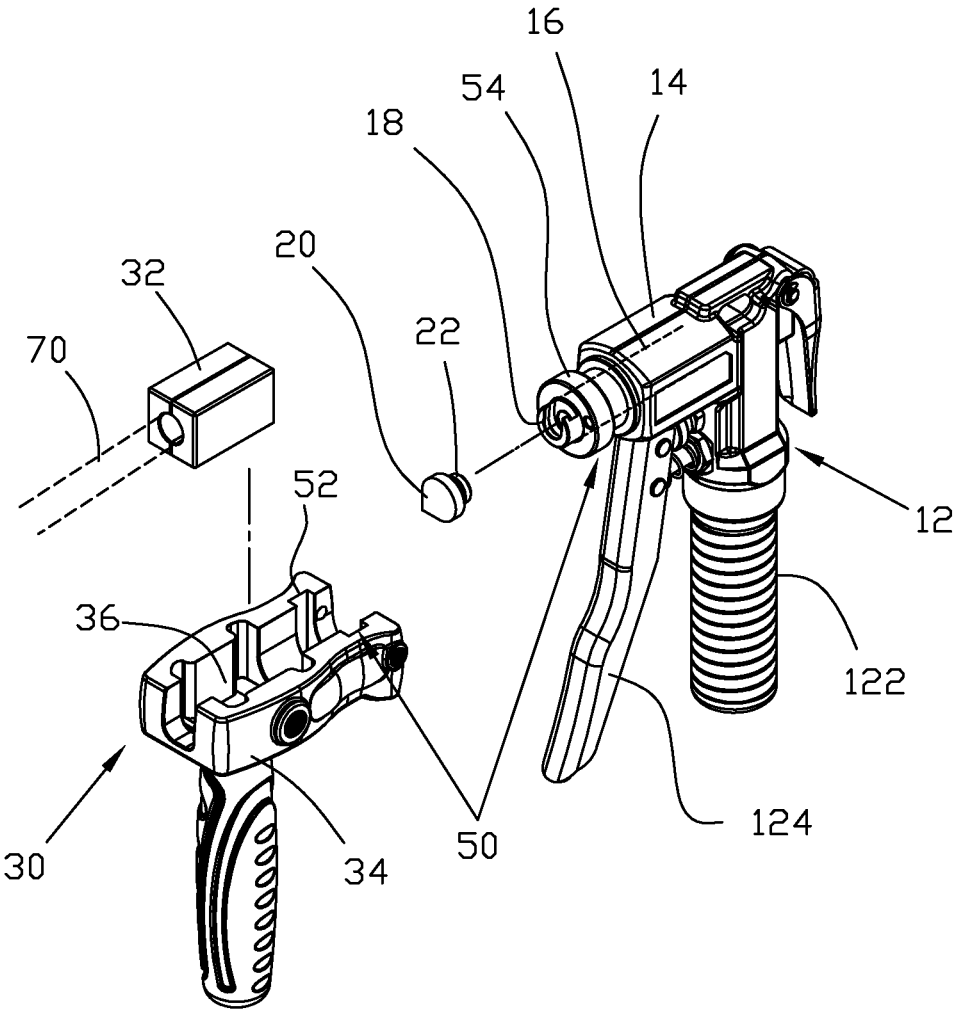
FIG. 3 is an exploded view of the preferred embodiment of the present invention.

As shown in FIGS. 1 and 3, the main member 10 includes an operating portion 12 and a driving portion 14. The operating portion 12 further includes a handle 122 and an operating device 124. An angle is formed between the operating portion 12 and the driving portion 14. An angle between the handle 122 of the operating portion 12 and the driving portion 14 is about 90 degrees. A driving axle 16 is provided in the driving portion 14, and has a engaging slot 18 at an end thereof.

A terminal 20 has an engaging section 22 at an end thereof to be engaged with the engaging slot 18 of the driving axle 16. The terminal 20 is an expanding terminal to expand a pipe. In another embodiment, the terminal 20 is a shrinking terminal (not shown) to shrink a pipe.

As shown in FIGS., a hydraulic pump is provided to drive the driving axle 16 in the driving portion 14 through the operating portion 12, so that the terminal 20 is moved along with the driving axle 16 to expand (or shrink) a pipe.

The clamping device 30 includes a clamping set 32 and a base 34. The clamping device 30 is arranged in an axial direction of the driving axle 16 in the driving portion 14. The clamping set 32 is provided in a chamber 36 of the base 34 to clamp a metal round pipe 70.

Figure 4:
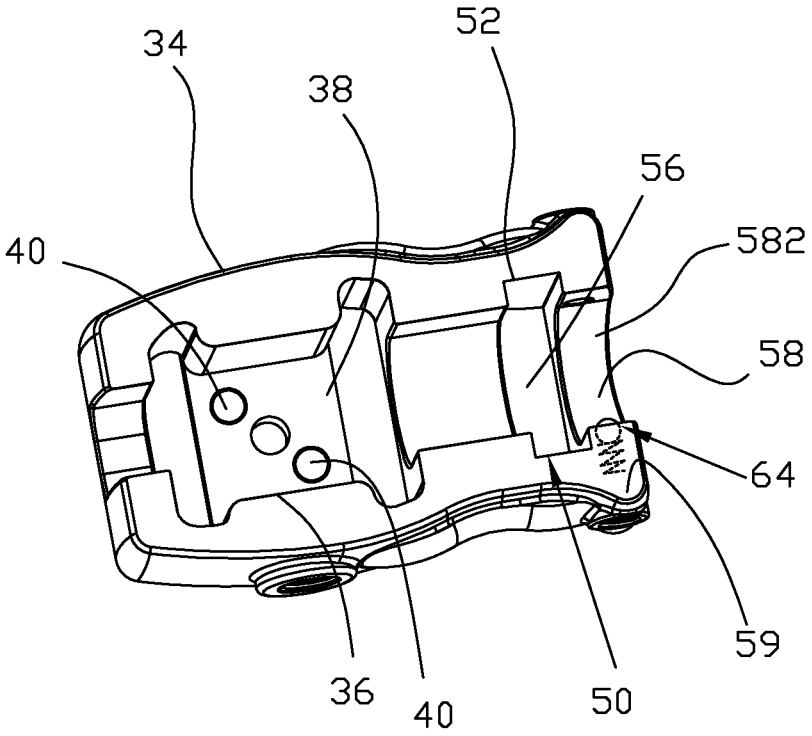
FIG. 4 is a perspective view of the base of the preferred embodiment of the present invention.

As shown in FIG. 4, the base 34 is provided with a magnetic device 40 on a bottom of the chamber 36. The clamping set 32 is attracted by the magnetic device 40 to be firmly positioned in the chamber 36. As a result, the clamping set is unable to escape from the chamber 36.

As shown in FIGS. 1, 2, and 3, the rotating mechanism 50 has a recess and an engaging block 54. The recess 52 is provided on the base 34 of the clamping device 30. The engaging block 54 is arranged in the axial direction of the driving axle 16 of the driving portion 14.

As shown in FIG. 4, the rotating mechanism 50 further has a slot 58 on an end of the base 34 beside the recess 52. The slot 58 has an opening end 582 while at least a connecting portion 59 is provided beside the opening end 582. An elastic positioning set 64, including a ball and a spring for example, is connected to the connecting portion 59. The elastic positioning set 64 has an end extending out of the connecting portion 59, and associated with the slot 58. A bore 56 is provided on a bottom of the recess 52.

Figure 5:
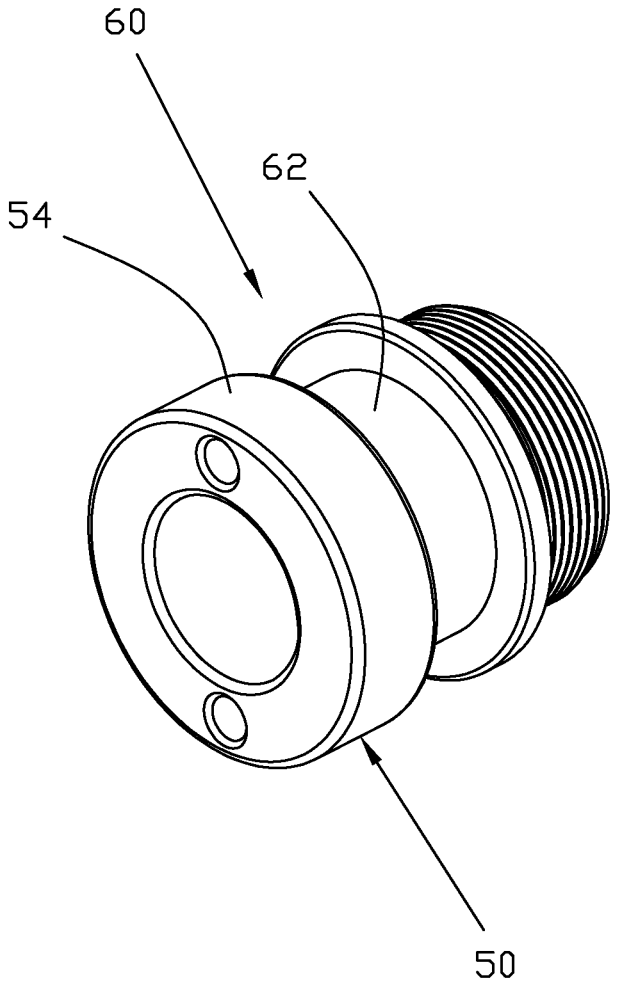
FIG. 5 is a perspective view of the pipe and the adaptor of the preferred embodiment of the present invention.

As shown in FIG. 5, the rotating mechanism 50 has a neck portion 62, and the neck 62 and the engaging block 54 are formed on a tube 60. The neck 62 is beside the engaging block 54, and has an outer diameter smaller than that of the engaging block 54. The engaging block 54 could be a round member, or any other suitable appearances.

Figure 6:
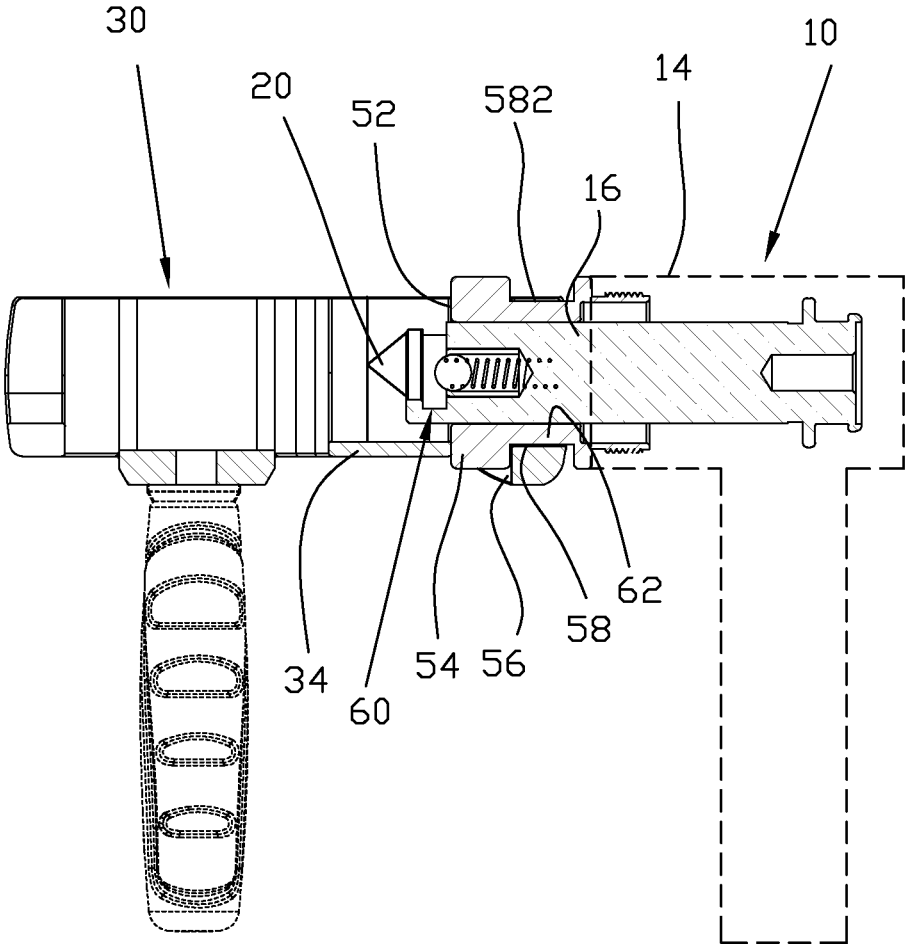
FIG. 6 is a sectional diagram of the preferred embodiment of the present invention, showing the rotating mechanism.
Figure 7:
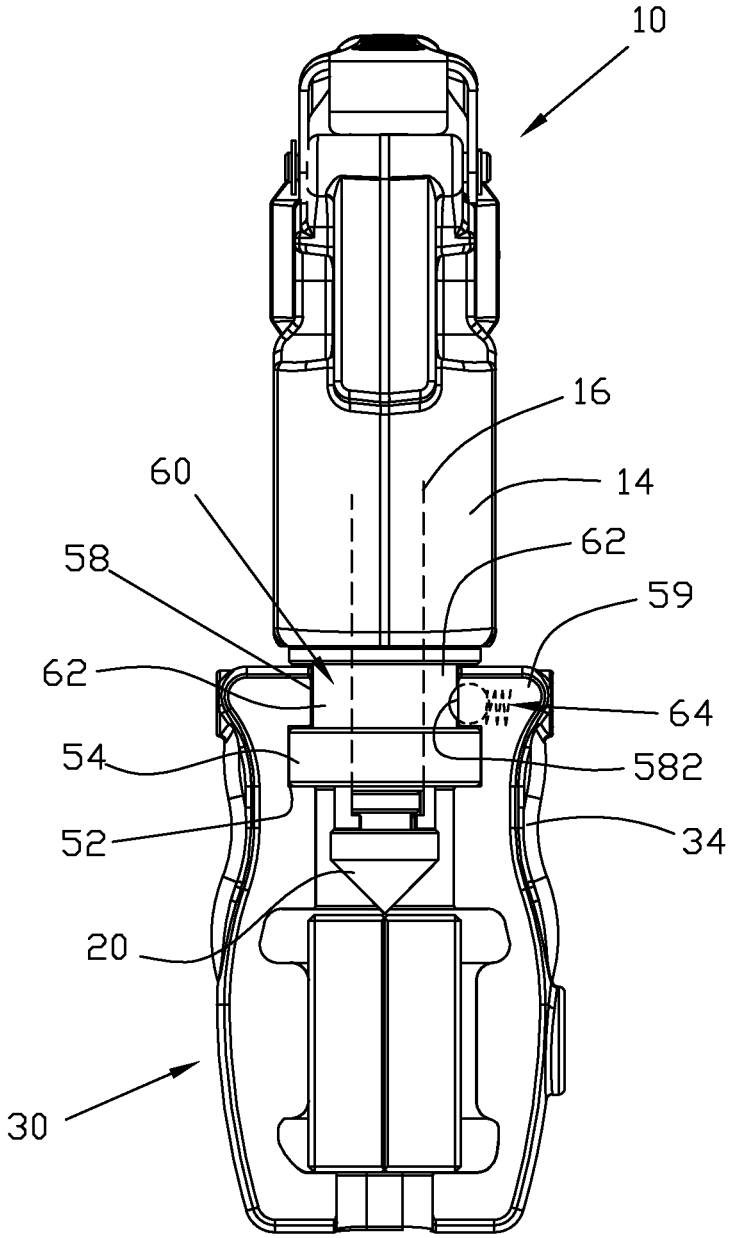
FIG. 7 is a top view of FIG. 6.

As shown in FIGS. 6 and 7, the tube 60 is connected or coupled to an end of the driving portion 14, and the driving axle 16 passes through the tube 60 to engage the terminal 20. The main member 10 and the clamping device 30 are connected together by the engagement of the engaging block 54 and the recess while the engaging block has a portion passing through the bore 56. The neck portion 62 engages the slot 58 to be abutted against the elastic positioning set 64. As a result, the engaging block 54 is free to rotate relative to the recess 52, and the neck portion 62 is free to rotate relative to the slot 58.

The engaging block 54 has a portion extending out of the bore 56 (FIG. 6) for engagement to prevent the clamping device 30 from escaping along the axial direction of the driving axle 16. The neck portion 62 engages the slot 58, and the elastic positioning set 64 urges the neck portion 62, so that the clamping device 30 is unable to be moved relative to the main member 10 unless a user exerts a force greater than the elastic positioning set 64 to separate the clamping device 30 from the main member 10 via the opening end 582. Besides, the arrangement of the elastic positioning set 64 and the neck portion 62 allows the clamping device 30 to rotate freely relative to the main member 10.

In conclusion, the rotating mechanism 50 or the arrangement of the rotating mechanism 50 between the clamping device 30 and the main member 10 makes the clamping device 30 rotates freely relative to the main member 10 through the engagement of the neck portion 62 and the slot 58, so that the angle of the clamping device 30 is adjustable.

The engaging block 54 has a portion out of the bore 56 could separate the clamping device 30 from the main member 10 along the axial direction of the driving axle 16. The arrangement and relative position of the elastic positioning set 64 and the neck portion 62 allows the clamping device 30 to rotate freely relative to the main member 10. As a result, the clamping device 30 is connected to the main member 10 always no matter the angle of the clamping device 30 is.

Since an angle is formed between the handle 122 and the operating device 124 of the operating portion 12 of the main member 10, and the clamping device 30 rotates freely relative to the main member 10, the pipe sizing toll of the present invention is able to be operated in a narrow space or a space hard to reach.

The rotating mechanism 50 of the present preferred embodiment is provided with the engagement of the neck portion 62 and the slot 58 and the engagement of the engaging block 54 and the recess 52. It further includes the slot 58 and the recess 52 provided on the base 34, and the engaging block 54 and the neck portion 62 formed on the tube 60. An alternate design could have the clamping device 30 connected to the driving portion 14, or provides a shaft and a hub to make the clamping device 30 rotate freely relative to the main member 10. Another alternate design is that the clamping device 30 is fitted to the driving axle 16 or the driving 14 for free rotation.

It must be pointed out that the embodiments described above are only some preferred embodiments of the present invention. All equivalent structures which employ the concepts disclosed in this specification and the appended claims should fall within the scope of the present invention.

What is claimed is:

1. A rotary pipe sizing tool for changing a diameter of a pipe, comprising:

a main member having a driving portion;

a clamping device provided at an end of the driving portion of the main member; and a rotating mechanism provided between the main member and the clamping device;

wherein the clamping device is free to rotate relative to the main member through the rotating mechanism;

wherein the rotating mechanism has a neck portion and a slot; the neck portion is provided on the main member, and the slot is provided on the clamping device; the neck portion engages the slot to make the clamping device rotate freely relative to the main member.

2. The rotary pipe sizing tool of claim 1, further comprising an elastic positioning set besides the slot, wherein the neck portion engages the slot, and the elastic positioning set has an end extending out of the slot to be abutted against the neck portion.

3. A rotary pipe sizing tool for changing a diameter of a pipe, comprising:

a main member having a driving portion;

a clamping device provided at an end of the driving portion of the main member; and a rotating mechanism provided between the main member and the clamping device;

wherein the clamping device is free to rotate relative to the main member through the rotating mechanism;

wherein the rotating mechanism includes a recess on the clamping device and an engaging block on the main member to engage the recess.

4. The rotary pipe sizing tool of claim 3, wherein the engaging block is a round member.

5. The rotary pipe sizing tool of claim 3, wherein the clamping device is provided with a bore on a bottom of the recess, and the engaging block engages the recess with a portion passing through the bore to hold the clamping device on the main member.

6. A rotary pipe sizing tool for changing a diameter of a pipe, comprising:

a main member having a driving portion, wherein the driving portion has a driving axle;

a clamping device having a base arranged in an axial direction of the driving axle;

a rotating mechanism provided between driving axle of the main member and base of the clamping device;

wherein the base of the clamping device is free to rotate relative to the main member through the rotating mechanism to adjust an angle between the main member and the clamping device;

wherein the rotating mechanism includes a tube with a neck portion thereon and a slot formed on the base of the clamping device; the tube is connected to the driving portion of the main member, and the neck portion engages the slot to make the clamping device rotate freely relative to the main member.

7. The rotary pipe sizing tool of claim 6, further comprising an elastic positioning set besides the slot, wherein the neck portion engages the slot, and the elastic positioning set has an end extending out of the slot to be abutted against the neck portion.

8. The rotary pipe sizing tool of claim 6, wherein the rotating mechanism includes a recess on the base of the clamping device, a bore on a bottom of the recess, and an engaging block on the main member and beside the neck portion; the engaging block engages the recess, and has a portion passing through the bore to prevent clamping device from escaping from the main member along the axial direction of the driving axle.

* * * * *